United States Patent [19]

Ferro

[11] Patent Number: 4,728,400

[45] Date of Patent: Mar. 1, 1988

[54] METHOD AND APPARATUS FOR EXTRACTION OF AMALGAMATABLE METALS FROM A SLURRY

[76] Inventor: Antonio Ferro, Via Maraini 7, Lugano Svizzera, Italy

[21] Appl. No.: 3,280

[22] Filed: Jan. 14, 1987

Related U.S. Application Data

[62] Division of Ser. No. 821,979, Jan. 24, 1986, Pat. No. 4,668,368.

[30] Foreign Application Priority Data

Apr. 11, 1985 [IT] Italy ..... 20302 A/85

[51] Int. Cl.[4] ..... C25D 3/02

[52] U.S. Cl. ..... 204/45.1; 204/43.1; 204/129; 75/118 R; 209/51

[58] Field of Search ..... 204/105 R, 109, 126, 204/129, 124, 44, 43.1, 45.1; 75/118 R; 209/51

[56] References Cited

U.S. PATENT DOCUMENTS 1,951,822 3/1934 Enzlin et al. ..... 204/124

4,062,744 12/1977 Henrie et al. ..... 204/124

*Primary Examiner*—R. L. Andrews

*Attorney, Agent, or Firm*—Murray and Whisenhunt

[57] ABSTRACT

Method for extracting metals amalgamatable with mercury from fluid material containing those metals in the form of metal particles. The method comprises contacting a slurry or aqueous solution containing metal particles of the metal to be recovered by amalgamation with a surface of a support amalgamated with mercury to form on the surface an amalgam with the metal to be recovered. A surface film is continuously removed from the surface of the support, and the surface of the support is continuously restored by electrolytic deposition of mercury thereon.

9 Claims, 3 Drawing Figures

METHOD AND APPARATUS FOR EXTRACTION OF AMALGAMATABLE METALS FROM A SLURRY

This is a division of application Ser. No. 821,979, filed Jan. 24, 1986, now U.S. Pat. No. 4,668,368.

BACKGROUND OF THE INVENTION

The present invention relates to the extraction of metals and their salts which are amalgamatable with mercury, in particular gold, and which are present in dispersed form in slurries such as for example alluvial sands. In the following description specific reference will be made to gold and to alluvial sands it being understood that such reference is not intended as a limitation but only as an example. Indeed it is known that with the exception of iron almost all other metals amalgamate to a greater or lesser extent with mercury so that the method and the apparatus in accordance with the invention may be applied in a similar manner.

It is also known that alluvial sands and deposits contain gold in very small proportions, of the order of 1 gram approximately for each ton of river sand and that such gold is found in various physical forms including lamellae, particles occlusions in grains, e.g. quartz, of varying grain size.

It is also known from the literature that gold combines very readily with mercury to form an alloy which takes the name amalgam and from which it can recovered equally readily.

If an intimate contact is made between the sand and the mercury, recovery of gold from the sand can reach 100% of the gold contained in the sand. Finally, it should not be forgotten that alluvial sands are used in the construction industry, for which they are extracted from quarries, manipulated, and handled often in the form of slurries and aqueous solutions.

Recovery of gold from alluvial sand with the amalgam formation method was well known in the rather distant past and is still in use today albeit sporadically, having been replaced by the cyanide process. The amalgam formation method consists of passing a slurry or an aqueous solution of sand over a surface made of copper amalgamated with mercury preferably in the presence of silver.

After a certain period of time, of the order of at least several days, i.e. when the mercury's amalgamation capacity is believed to be exhausted, the copper and mercury amalgam support bearing the gold also amalgamated with the mercury is treated for recovery of the gold and optionally for restoration of the support.

Although the preceding description is extremely concise it can readily be appreciated that the known method presents two serious disadvantages and problems, i.e. it is entirely empirical and allows no control of the process and in the second place but not of secondary importance it has the disadvantage of involving totally manual operations. It is clear that these problems and disadvantages preclude any modern industrial use of this process.

On the other hand even the cyanide process presents drawbacks and risks. Finally it is worth noting that a quarry of not excessive size processes daily quantities of gravel and sand of the order of hundreds of tons so that the real interest which the recovery of the gold in such sand could have, and indeed has, can be quickly understood. The main problem connected with reovery of the gold content of alluvial sands is however the formation of a surface film of mercury sulfides. Indeed often because of polluting substances contained in river water and also because of sulfur and/or sulfides present in alluvial sands, the sulfides combine with the mercury to form an impermeable film on the surface of the mercury which inhibits amalgamation with the gold. The main object of the present invention is to solve said problems and drawbacks.

One specific object of the present invention is to provide a method and equipment which would allow recovery, in an acceptable and profitable manner, of metals which are amalgamatable with mercury, more specifically noble metals and still more specifically silver and gold, from alluvial sands and aqueous slurries.

SUMMARY OF THE INVENTION

The method in accordance with the present invention of the type wherein a support preferably of copper amalgamated with mercury is put in contact with the slurry of the aqueous suspension to be processed in such a manner that the particles of metal to be recovered by amalgamation, in particular gold particles, come in contact with the mercury of said support, is characterized essentially by the operations: (a) continous removal from the mercury of the surface film which may contain sulfides and (b) continuous restoration of the surface on which the amalgam is formed with the metal particles to be recovered by electrolytic deposit of mercury thereon.

One embodiment of this method calls for continuous recovery of the film removed from the support and separation therefrom of the metal to be recovered.

The apparatus in accordance with the present invention is characterized in that it comprises a cylindrical surface lined internally with a layer of copper amalgamated with mercury. The apparatus is comprises first means held in contact with at least one portion of the surface of the copper layer amalgamated with mercury for the electrolytic deposit of mercury from an aqueous solution of mercury salts, the first means receiving a positive electrical charge in such a manner as to act as an anode while the cathode consists of copper to be reamalgamated. A second means is provided for removing the surface film from the layer of copper amalgamated with mercury, the second means being arranged upstream in the direction of movement of the linining of copper amalgamated with mercury with respect to the first means so that the electrolytic deposit of mercury takes place on the surface free from sulfide surface encrustations. In conformity with a first embodiment of the apparatus according to the invention, the cylindrical surface is described by a cylinder which turns about its axis preferably due to the action of external driving rolls, the first means consisting of permeable buffers which are held in rubbing contact with the inner surface which bears a sleeve or lining of copper amalgamated with mercury. The buffers are fed with a solution of mercury nitrate in water and there being positioned in the buffers electrodes passing through inner channels provided for inflow of the aqueous solution of mercury salt sand, the electrodes being connected to the positive pole of a voltage generator and the copper sleeve or lining being connected to the negative pole.

In accordance with the above first embodiment the voltage difference between the cathode and the anode is greater than that theoretically necessary for electrolysis of the aqueous solution of mercury salts. As a result, electrolysis of the water is brought about so that there is a certain development of nascent hydrogen in the cathode area and the parachor of the cathodic mercury is attenuated.

In a second embodiment of the apparatus according to the invention, the cylindrical surface is formed of a cylinder with a horizontal axis bearing a lining of the type described above. In the cylinder, mounted in a turning manner is a screw feeder fed upstream by a force pump for the slurry and communicating at the downstream end with a discharge cone having a vertical axis and turned upward so as to exploit change in velocity to hold back and then capture the gold particles not captured by amalgamation.

Basically therefore in the first embodiment rotation of the cylinder fed with slurry causes intimate contact of the slurry and hence with the gold particles and the mercury while in the second embodiment it is the screw feeder which in its rotation projects the slurry against the inner surface of the horizontal cylinder and then against the surface of copper amalgamated with mercury.

To recover the components of the amalgam recourse is made to a normal electrolytic cell in which the amalgam to be processed and a normal titanium basked coated with synthetic such as meracolon material constitute the anode while the cathode consists of copper to be reamalgamated.

The electrolytic solution thanks to which mercury is redeposited on the copper lining is for example an aqueous solution containing 20–30 grams per liter of $KNO_3$ and 50–100 grams per liter of $HgNO_3$. Preferably the solution contains 0.05% of $AgNO_3$.

BRIEF DESCRIPTION OF THE DRAWINGS

In the annexed drawings are shown schematically the two embodiments of the apparatus in accordance with the invention, in which.

DETAILED DESCRIPTION OF THE INVENTION

Figure 1:
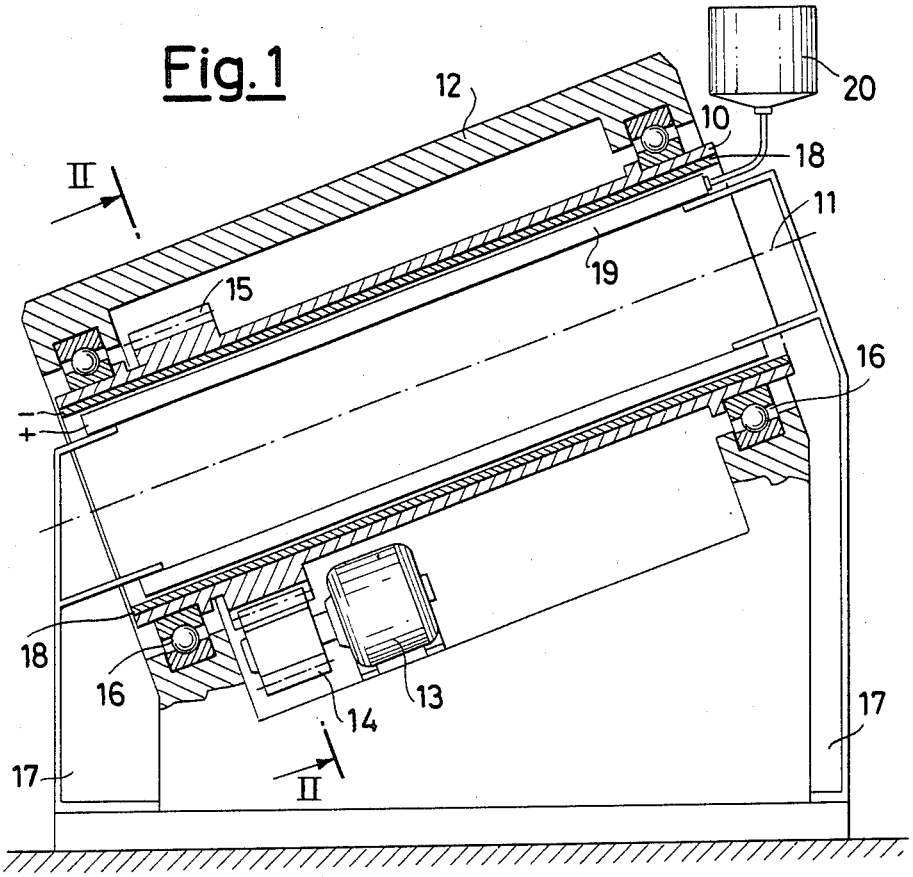
FIG. 1 is a sectional side view of the first embodiment.
Figure 2:
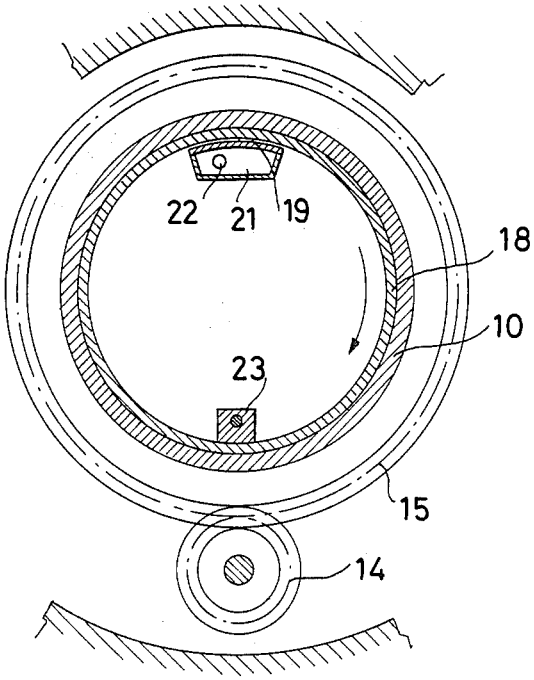
FIG. 2 is a sectional view along II—II of FIG. 1.

With reference first to FIGS. 1 and 2 the apparatus in accordance with the invention comprises a cylinder 10 arranged in an inclined manner and installed in such a manner as to rotate around its axis 11. For this purpose rolling bearings 16 are provided between the cylinder 10 and the fixed casing 12. Rotation is provided by the motor 13 which drives the gear unit 14 in engagement with a ring gear 15 which is integral with the external surface of the cylinder 10. The casing 12 is in turn mounted on a bed 17.

The internal surface of the cylinder 10 is coated with a layer 18 of copper amalgamated with mercury which turns together with the cylinder 10. One or more buffers 19 are mounted in such a manner as to be continuously in contact with the exposed surface of the layer 18.

The buffers are made of porous material in such a manner as to transfer to the adjacent surface the aqueous electrolytic solution which is fed from the tank 20 to the internal channel 21 of the buffers 19.

In the channel 21 are also housed tubular electrodes 22 connected to the positive pole of a voltage generator of which the negative pole is connected to the layer 18 of copper amalgamated with mercury. In this manner the solution which impinges on the surface of the layer 18 undergoes electrolysis, depositing metallic mercury on the surface of layer 18.

At the same time as already mentioned the voltage being higher than that necessary only for electrolysis of the mercury salts also brings about at least partial electrolysis of the water accompanied by development of nascent hydrogen at the cathode.

For this purpose it has been found that the aforesaid voltage differential must be such as to cause the passage of a current in the contact points between the buffer 19 and the layer 18 of adequate intensity and voltage.

From the practical tests conducted with the apparatus just described it was observed that the sulfide formation which when operating in accordance with the prior art would take place in a few seconds, at the most minutes, is completely eliminated. Moreover analysis of slurry issuing from the lower end shows that gold recovery is nearly complete.

It should also be observed that the recovery process in accordance with the present invention does not intefere with normal sand processing and therefore does not affect normal operations in the quarry.

Reference number 23 indicates schematically brush or knife means for scraping the surface of the layer 18 to remove the surface film formed by the amalgam of mercury, gold, and copper, as well as possible sulfide encrustations.

This surface film is transferred, e.g. through channels or by suction, to the gold recovery means described above.

It should be observed that by reason of the permeability of the amalgam of copper and mercury the buffers 19 may be positioned outside the layer 18, i.e. between the layer 18 and the cylinder 10 integrally with the cylinder. In the same manner the brush or knife means could be integrated with the buffers or shoes 19 to fulfill the same function.

Figure 3:
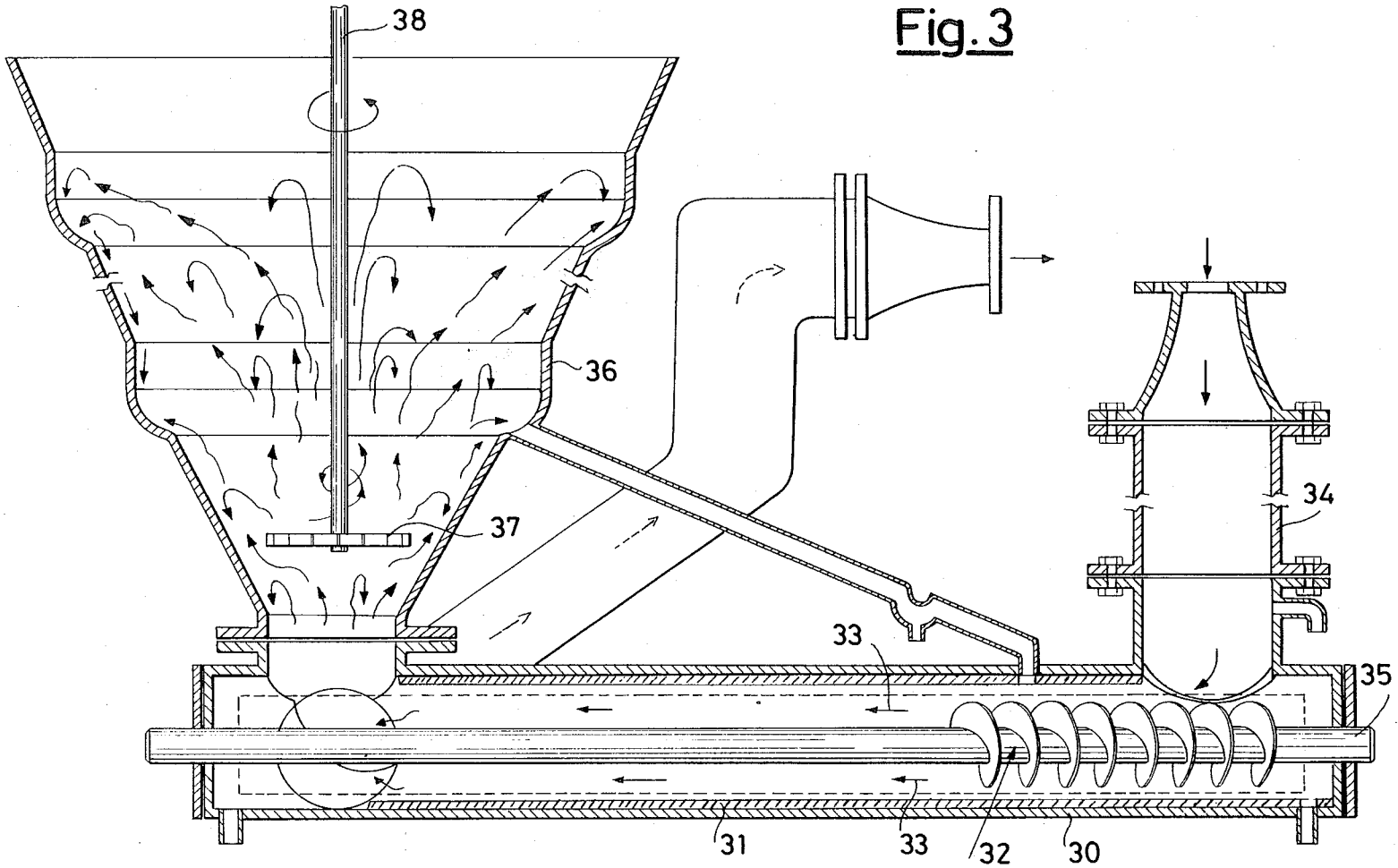
FIG. 3 is a sketch of the second embodiment.

Referring now to FIG. 3 there is shown an apparatus comprising a horizontal cylinder 30 lined internally with a layer 31 of copper amalgamated with mercury. The layer 31 is renewed and treated in the same manner as that described for FIGS. 1 and 2 except that the treatment takes place externally by arranging on the surface of the layer or sleeve 31 buffers or shoes like those shown in FIGS. 1 and 2 with reference number 19 and similar in all ways to them (surface, porosity, feeding with an electrolytic solution, arrangement of the electrodes) except that the buffers are caused to rotate around the external surface of the layer 31 which remains stationary.

For the sake of clearer representation however these details are omitted from FIG. 3.

Inside the cylinder 30 is mounted a screw feeder 32 made to rotate around its own axis 35 by drive means, not shown.

At the upstream end of the cylinder 30 referring to the direction of flow of the slurry indicated by the arrows 33 is mounted a feed tank 34 to which a pump which is not shown feeds the slurry to be processed.

At the downstream end of the cylinder 30 is the mouth of a discharge duct or the lower one of a hopper-type separator 36 inside which is mounted an agitator 37 the shaft 38 of which is made to rotate by drive means not shown. In this manner the slurry undergoes slowing which allows the gold particles which may have escaped formation of amalgam with the mercury to fall and to be optionally passed a second time through the cylinder 30.

In this case the screw feeder projects the slurry violently against the sleeve 31 of copper amalgamated with mercury bringing about two concomitant effects namely (a) intimate contact of the slurry with the mercury surface and (b) removal of the surface film or sulfide encrustations.

In this case of course at periodic intervals the copper and mercury sleeve enriched with gold is withdrawn for recovery of the gold.

This second embodiment of the apparatus according to the invention may be mounted on a mobile carriage allowing it to be transferred to and used in areas in which gold is more likely to be present.

The essential characteristics of the invention have been described but it is understood that conceptually equivalent modifications and changes are possible and foreseeable without going outside of its scope.

What is claimed is:

1. Method for extracting metals amalgamatable with mercury from fluid material containing said metals in the form of metal particles, said method comprising:

contacting a slurry or aqueous solution containing metal particles of a metal to be recovered by amalgamation with a surface of a support amalgamated with mercury to form on said surface an amalgam with said metal to be recovered;

continuously removing a surface film from said surface of said support; and continuously restoring said surface of said support on which said amalgam is formed by electrolytic deposition of mercury thereon.

2. A method according to claim 1 wherein said support is comprised of copper amalgamated with mercury.

3. A method according to claim 1 wherein said metal particles to be recovered are gold particles.

4. A method according to claim 3 wherein said extraction is performed on aqueous suspensions or slurries of alluvial sands to recover said gold particles.

5. A method according to claim 1 wherein said film removed from said support contains sulfides.

6. A method according to claim 5 wherein said film removed from said support is recovered in a continuous manner and the metal to be recovered is separated from said film.

7. A method according to claim 2 wherein said surface of said support is wetted with an aqueous solution of mercury salts and electrolysis of said aqueous solution is performed in such a manner as to deposit metallic mercury on said surface for amalgamation with said copper to form a copper-mercury amalgam.

8. A method according to claim 7 wherein said aqueous solution includes a silver salt having the function of improving the formation of said copper-mercury amalgam.

9. A method according to claim 7 wherein said electroylsis is performed at a current intensity so as to cause not only electrolysis of said mercury salts but also at least partial electrolysis of the water.

* * * * *